US005870869A

United States Patent [19]

Schrader

[11] Patent Number: 5,870,869

[45] Date of Patent: Feb. 16, 1999

[54] YIELDING TIE BAR

[76] Inventor: Ernest K. Schrader, Blue Creek Rd., Rte. 4, Box 264B, Walla Walla, Wash. 99362

[21] Appl. No.: 704,833

[22] Filed: Aug. 28, 1996

[51] Int. Cl.[6] ..... F04B 1/48; E01C 11/14

[52] U.S. Cl. ..... 52/396.02; 52/318; 52/573.1; 404/60; 404/62

[58] Field of Search ..... 52/318, 396.02, 52/396.04, 396.05, 396.08, 573.1, 378, 379, 582.1, 585.1; 404/47, 56, 59, 60, 62, 63; 14/73.1

[56] References Cited

U.S. PATENT DOCUMENTS

| | | | |
|---|---|---|---|
| 2,106,095 | 1/1938 | Heltzel . | |
| 2,299,670 | 10/1942 | Westcott . | |
| 2,605,680 | 8/1952 | Yeoman | 404/59 |
| 2,858,748 | 11/1958 | Crone | 404/59 |
| 4,449,844 | 5/1984 | Larsen | 404/60 |
| 4,733,513 | 3/1988 | Schrader et al. | 52/396.02 |
| 4,752,153 | 6/1988 | Miller | 52/396.02 X |

*Primary Examiner*—Christopher Kent
*Assistant Examiner*—Timothy B. Kang
*Attorney, Agent, or Firm*—Banner & Witcoff Ltd.

[57] ABSTRACT

A yielding tie bar transfers load stress across a joint between adjacent concrete slabs, and accommodates internal movement of the slabs to reduce cracking. A combination of adjacent slabs have a cracking strength and comprise a plurality of such tie bars. A yieldable strip made of yieldable metal is welded to the bar and mounted near each end of the bar perpendicular to the bar axis. The strip has a predetermined yield strength (a) sufficient to restrain slab movement in a direction which opens the joint, and (b) yielding in the metal thereof to an extent that will prevent substantial cracking of the slabs. The bar is preferably rectangular and further comprises a resilient facing attached to at least one face to accommodate movement perpendicular to the facing. As preferred, the bar yield strength is sufficient to restrain slab movement at forces between the slabs below 80% of the slab cracking strength, and insufficient to restrain slab movement above at least 80% of the slab cracking strength. The strips are preferably made from a non ferrous metal or plastic resin.

16 Claims, 3 Drawing Sheets

FIG. 1
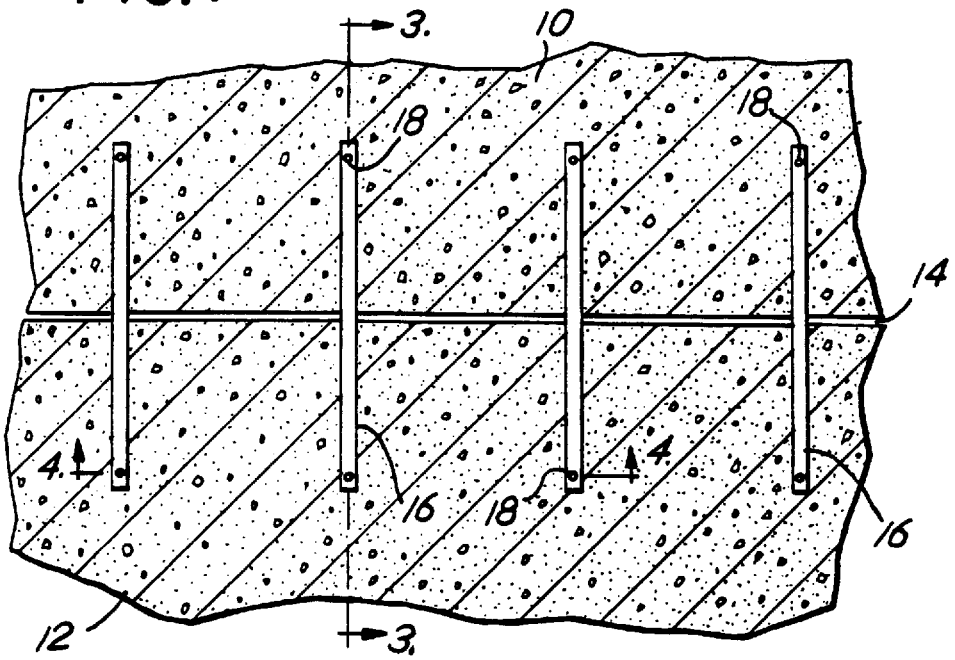
FIG. 2
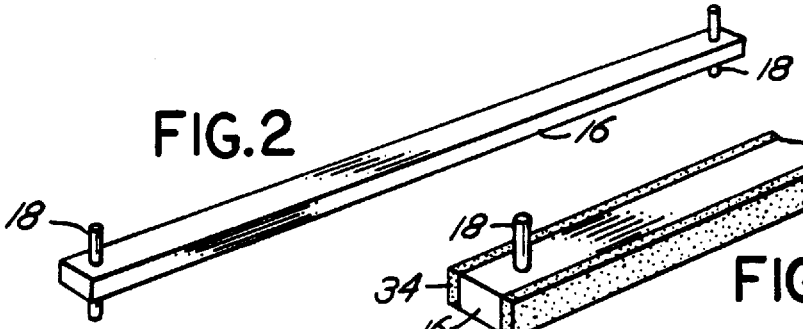
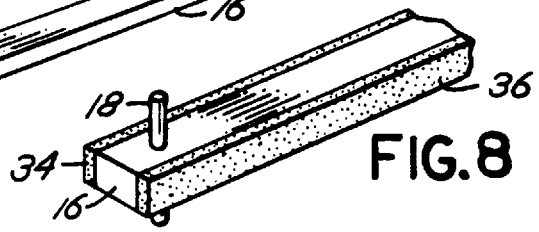
FIG. 8
FIG. 3
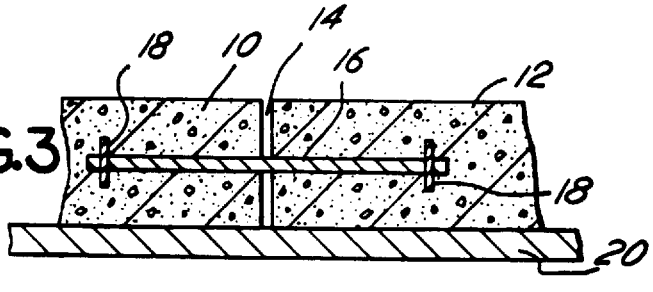
FIG. 5
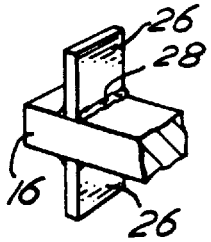
FIG. 4
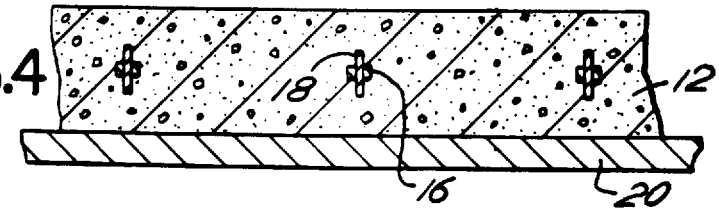

INDIVIDUAL BAR PULLOUTS
TIE-BARS

YIELDING TIE BAR

BACKGROUND OF THE INVENTION

The prior art discloses bars of various constructions which extend across the joints between adjacent concrete slabs to provide vertical shear stress load transfer. Dowels are smooth bars, not bonded to the concrete, and allow movement of the concrete with respect to the bars so that upon shrinkage of the concrete, the joint may open. Wide gaps between slabs admit water, salt and foreign materials which erode the joint. Dowels, therefore, may be effective in vertical shear stress transfer, but do not limit or control the maximum joint gap width. Tie bars traditionally are deformed reinforcing bar segments that cross the joint to provide vertical load transfer and also tie the adjacent concrete slabs together so that the joint does not open. Tie bars keep adjacent slabs from floating apart, but because they provide a rigid connection, the joint cannot open sufficiently to relieve internal stresses in the concrete. The tendency of slabs to pull away from each other at the joint is typically caused by contraction of the concrete due to drying, shrinkage, thermal contraction, or the tendency of a slab to slide downhill on a sloped surface. When the joint is prevented from opening, the movement which relieves shrinkage stresses in the slabs is almost totally prevented. This results in cracking or reduced capacity of the slab to carry its intended applied loads such as vehicular traffic.

PRIOR ART

Heltzel, U.S. Pat. No. 2,106,095, discloses a series of rods which extend from one concrete slab to another. Each rod has one downturned end to anchor the rod in the concrete. The straight end opposite the downturned end extends slidably into the adjacent slab so that the slabs may move freely toward and away from each other. The rods do not prevent the slabs from moving apart.

Westcott, U.S. Pat. No. 2,299,670, discloses spanning the joint between slabs with a short dowel which is telescoped into a pair of bearings or sleeves within radial arms embedded in the concrete. The sleeves are temporarily keyed to the ends of the dowel by soft metal pins which extend through aligned holes in the sleeve and the dowel. These pins do not provide any significant resistance to the movement of the slabs, the object of the invention being to permit the dowel "to move freely to accommodate the movement of adjoining slabs during periods of volume change".

Larsen, U.S. Pat. No. 4,449,844, discloses a dowel of conventional construction for transferring vertical shear stress and bending moments across transverse joints in concrete pavement slabs and for controlling the joint gap width. The dowel has outer ends which are deformed to secure a bond with the concrete while the central segment is disposed within a sleeve of polyethylene. This central section does not bond to the concrete. Thus, relative movement between the slab sections will cause the unbonded segment within the sleeve to slightly stretch or contract as the bonded end portions move with the respective slab sections. In a preferred construction, the dowels are used in pairs with one adjacent the top surface and the other one adjacent to the bottom surface. End anchorage is accomplished by bonding a substantial length of the bars which have continuous surface deformations, as commonly used for reinforcing poured concrete. The deformations do not yield under the force of concrete movement, but remain firmly anchored to prevent that portion of the bar from pulling out of the concrete without stretch, slip or distortion.

SUMMARY OF THE INVENTION

The object of my invention is to provide a simple inexpensive yielding tie bar and joint construction which imparts a predetermined resistance to movement of the adjacent concrete slabs, which resistance is near but less than the designated tensile strength of the concrete slabs. The tie bars assure that the slabs will have substantial resistance to opening and keep the slabs from floating apart, while allowing a minor opening at the joint. A further object is to allow the joint to open a very small predetermined distance, with increasing resistance to opening with increasing movement, which movement relieves internal stresses to prevent cracking or reduced capacity of the slab to carry its intended applied loads.

Another object is to provide a yielding tie bar which not only permits a predetermined limited amount of slab movement in a direction parallel to the axis of the tie bar, but also permits the concrete to move in a direction perpendicular to the axis of the tie rod, thus reducing additional stresses within the slab, particularly near the ends of the tie bars. This construction functions (1) to carry the imposed vertical load across the joint and distribute the load to the adjoining slab, and (2) to permit sufficient movement of the slabs to relieve forces from shrinkage or contraction in a direction parallel to, as well as, perpendicular to, the tie rod.

These and other objects are achieved by providing at each end of a smooth bar a projection in the form of a pin, bolt, or raised deformation having a predetermined yield strength, the projection lying in a plane perpendicular to the tie bar. Because the modulus of the concrete is high, the amount of movement or joint opening required to relieve substantial stress is quite low, but still substantially greater than the negligible amount of movement allowed by prior art tie bars which prohibit a joint opening in excess of about 0.005 inches. Projections or pins used in the tie bars of the invention must yield by bending or deforming to allow controlled limited joint opening within the range of 0.005–0.125 inches. The opening of the joint allows relief of the stress in the concrete slabs which would result in cracking if no movement is permitted.

In accordance with my invention, as the force tending to separate adjacent slabs increases, resistance to joint opening increases in direct linear proportion to the opening of the gap. Initially, the distance the bar moves is equal to the slip or slack between the pin and the opening in the bar. The pin then begins to deform within its elastic limit or range. When the yield stress of the pin is reached and/or the pin starts to bend, the resistance to further opening of the gap increases only slightly with additional gap opening. When the ultimate strength of the pin is reached, it breaks. The ultimate strength of the pin, bolt, or projection is selected so that the part fails before the concrete begins to crack.

After the material in the pin, bolt, or projection has been loaded to its yield stress, the part begins to deform substantially more for each increment of added stress. At loads above the yield point, deformation is no longer directly proportional to the applied load. The projection then begins to bend as well as yield, thereby providing limited resistance to gap opening, or bar pull-out. In conventional tie bars, the resistance to pull out, essentially complete, is controlled by the area of the bar and by the bond provided by the continuous surface deformations.

Larsen obtains extensibility in a conventional tie bar by stretching the central unbonded portion. To obtain the desired elongation responsive to the contracting forces, the cross section of the central unbonded portion must be reduced, which in turn reduces vertical shear strength required for load transfer between slabs. In contrast, the size of the bars of the invention is selected to provide the desired vertical shear strength without regard to elongation, because the desired yielding is achieved solely by the projections extending from the bar.

The yield strength, or resistance of the yielding tie bar, can be adjusted for various slab designs, maximum stress levels, and desired movement, by changing the length, diameter, or modulus of the pin, bolt, or projection; using a bolt and nut with soft or oversized washers that slip; or applying a soft or yielding material to the pin or bolt.

In a preferred form of the invention, the smooth tie bar is of square or rectangular cross section and has a resilient facing of rubber or plastic attached to at least one face of the bar to provide for movement of the concrete in a direction substantially perpendicular to the resilient facing. The surface of the facing is smooth like the surface of the bar and does not bond the bar to the surrounding concrete. Thus, the sole element for controlling the resistance of the slab to movement parallel to the bar axis is the pin, or projection, extending normal to the face of the bar.

BRIEF DESCRIPTION OF THE DRAWINGS

FIG. 1 is a plan view in section of a portion of a joint between two concrete slabs tied together with yielding tie bars of the invention.

FIG. 2 is a perspective view of one form of the tie bar of the invention.

FIG. 3 is a section taken along the line 3—3 of FIG. 1 showing the portion of the concrete slabs on a substrate.

FIG. 4 is a section taken along the line 4—4 of FIG. 1.

FIG. 5 is an enlarged side view of a yielding metal strip mounted near the end of a tie bar.

FIG. 8 is a perspective view of the tie bar of FIG. 2 having a resilient facing on opposed sides.

DETAILED DESCRIPTION OF THE PREFERRED EMBODIMENT

Figure 6:
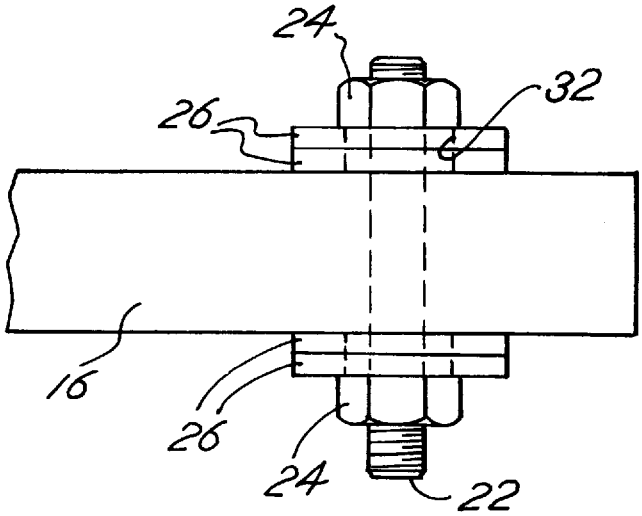
FIG. 6 is an enlarged side view of a yielding bolt mounted near the end of the tie bar, secured to the bar by nuts with oversized washers disposed between the nuts and the bar.

FIGS. 1, 3 and 4 depict a portion of a typical concrete pavement showing the joint 14 between adjacent slabs 10 and 12 poured on substrate 20. Embedded in concrete are yielding tie bars of the invention, each of which consists of a smooth steel bar 16 rectangular in cross section having metal pins 18 inserted or swaged in openings through the bar. The bars are selected from standard product sizes of ½, ¾, 1, 1¼, and 1½ inches square, or if rectangular or round, having equivalent cross sectional areas. The bars are usually from 1½ to 3 feet long. They are positioned above the substrate 20 and supported in that position during the pouring of the concrete.

Pins 18 are disposed perpendicular to the axis of the bar and extend an equal distance from the upper and lower surfaces thereof as best shown in FIG. 2. Although the bar depicted is rectangular in cross section, it can be round or other suitable configuration. Pins 18 may be made from steel, a non ferrous metal, or plastic, e.g., polypropylene, depending upon the desired yield strength. The yield strength of the pins can be adjusted by selecting different sizes as well as different materials. Longer, thicker pins are used to provide increased yield strength. Pin diameter will be in the range of ¼ to ⅜ inch for smaller bars and 7/16 to 9/16 inches for longer bars.

The cross sectional size of the bar is based on the design criteria for the strength and thickness of the concrete slab as is now calculated with conventional dowels and tie bars. The pin size must be compatible with the bar size and spacing of the bars as well as with the strength and thickness of the concrete slab. Those skilled in the art of concrete slab and joint design understand these structures and will be able to select appropriate sizes and materials for the bars and the yielding pins. The designer will specify the bar cross sectional area for the yield strength of the system, including the joint spacing and the ingredient proportions of the concrete mix. The size of the bars and the size and strength of the pins are selected in accordance with these design criteria.

FIG. 5 shows projections in the form of metal fins 26 secured by welds 28 to the surface of bar 16. These fins yield under smaller forces than the bolt structure of FIG. 6. One skilled in the art will understand that other geometric shapes and sizes can be used to provide varying yield strengths.

FIG. 6 shows a threaded bolt 22 secured in one end of bar 16 with a nut 24 and optionally two oversized washers 26 on each side of the bar. The opposite end is similarly constructed. This construction is simple to assemble using standard, readily available bolts of any desired size as dictated by the yield strength required for the concrete slab design.

Figure 7:
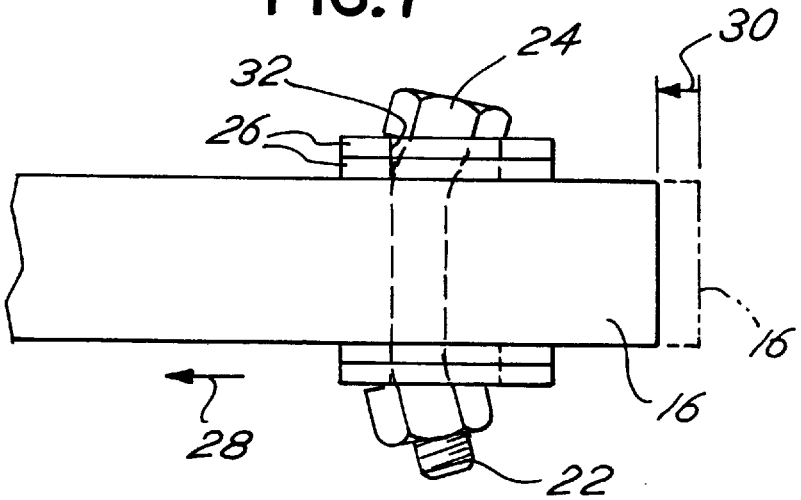
FIG. 7 shows the bar, bolt, washer, nut assembly of FIG. 6 after deformation.

FIG. 7 shows the position of the bolt/washer, nut combination of FIG. 6 after the bar 16 has yielded in the direction of arrow 28 under the force of concrete contraction, a distance indicated at 30. The force reacting to the movement of the bar from slip and yield is that required to displace the oversized washers 26 and subsequently to bend the bolt 22. The washers slide normal to the bolt until the inner surface of the washers abut the bolt as indicated at 32.

As contracting concrete causes the bar 16 to move, the bolt 22 becomes loaded to its yield stress. Upon application of further load, the oversized washers move toward the bolt and finally the bolt begins to deform as shown in FIG. 7, thereby providing resistance to bar pull-out. If the contraction is severe, the bolt, the size and quality of which is predetermined, will fail, but prior to reaching the load at which the concrete would crack.

The shear strength of the bolt or pin may be determined as follows. Assume a standard design table for six inch slabs of concrete having a compressive strength of 4000 psi and a tensile or cracking strength of 500 psi, tied with ¾ inch bars of square cross section, spaced 12 inches apart.

One bar with 12 inch spacing=one bar per 12 inches×six inches (thick)=72 inches$^2$.

Concrete cracking strength=72 inches$^2$×500 psi=36,000 lbs.

A bolt or pin is selected which will shear at 80% of the concrete cracking load. 0.8×36,000 lbs.=28,800 lbs.

Since the bolt shears at top and bottom, the cracking loading is ½ of 28,800 lbs. or 14,400 lbs. A steel bolt or pin ⅜ inches diameter has a cross sectional area of 0.11 inches$^2$. The desired ultimate stress=

$$\frac{14{,}400 \text{ lbs.}}{0.11} = 131{,}000 \text{ psi}$$

A ⅜ inch grade 60 steel bolt yields at about 60,000 psi and fails at about 130,000 psi. This selection provides a bolt that yields to permit controlled joint opening well prior to the concrete cracking while also assuring that the anchorage will fail at a load of about 28,800 lbs., well below the 36,000 lbs. calculated load at which the concrete will crack. The bolt should be long enough to extend beyond the upper and lower surfaces of the bar by about ½ inch. This size will yield prior to shearing.

It is also desirable to check the yield stress of the ¾ inch square bar at the end of the anchorage to make sure that the bar does not break out at the reduced end surrounding the bolt. This would occur if the land surrounding the bolt is very thin, or if the bolt is made of very high tensile metal. A ¾ inch square bar has a yield stress of 60,000 psi. When the cross sectional area is reduced by the size of the ⅜ inch diameter bolt, the area equals 0.2813 inch. 60,000×0.2813= 16,875 lbs. which is less than 28,800 lbs. Both the bar at the reduced section and the bolt will yield prior to concrete cracking.

Figure 9:
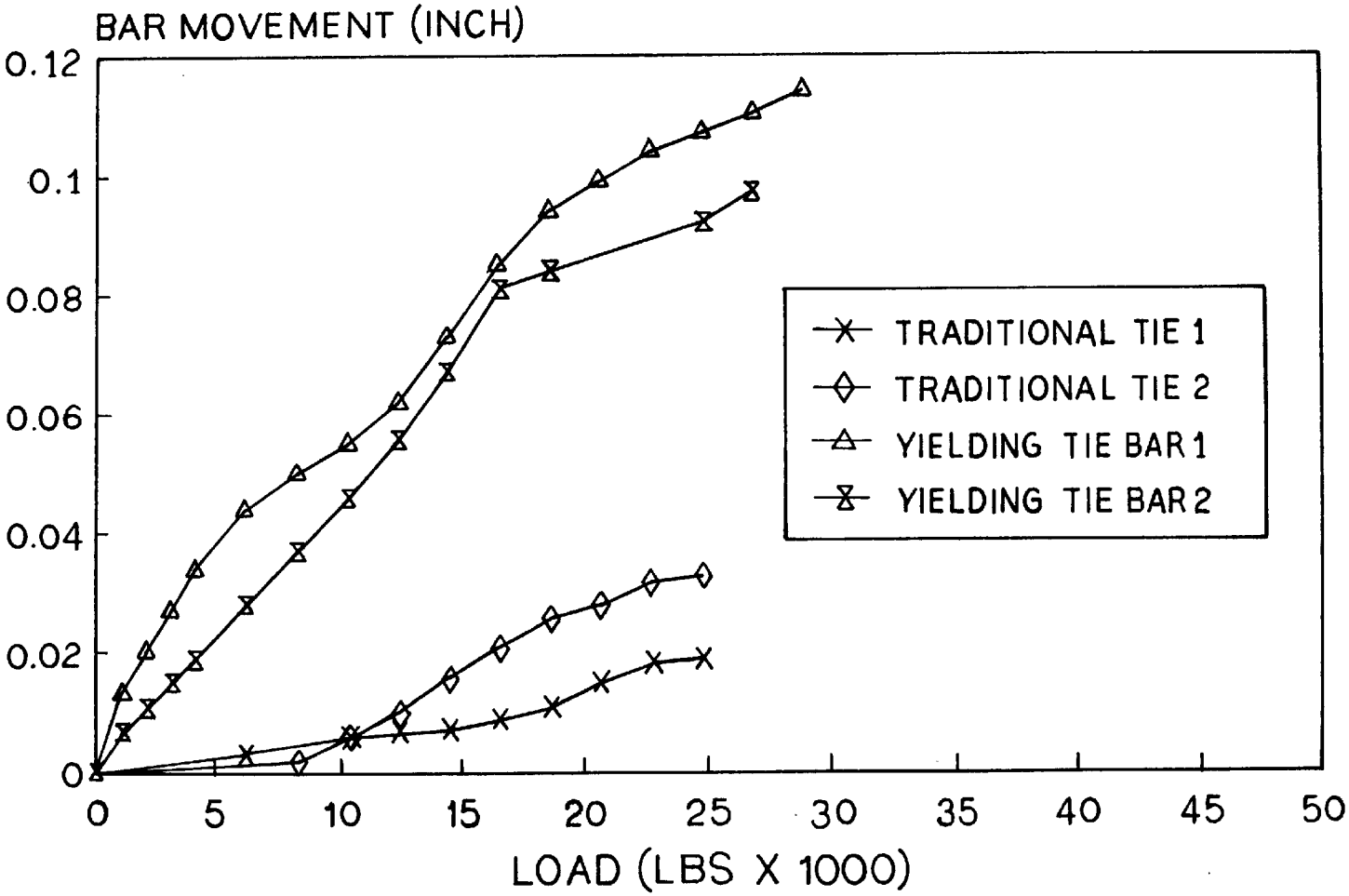
FIG. 9 shows graphically the amount of bar movement resulting from increasing loads imposed on a conventional tie bar as compared to a yielding tie bar of the invention.

The yielding tie bars corresponding to the above calculations were field tested. The results are shown graphically in FIG. 9. Two test bars of identical construction representing current normal industry practice were compared with two tie bars of the invention by measuring bar movement under loads applied to failure. The normal industry practice bars were standard #6 (nominal ¾ inch diameter) deformed bars meeting the requirements of American Society for Testing and Materials (ASTM) standard A616. The bars of the invention were non-deformed (smooth) ¾ inch square bars with ⅜ inch diameter bolts used for end pins. Washers were used at the head and nut of the bolt. The bars were cast into six inch thick slabs of nominal 4,000 psi concrete with an embedment length of nine inches. This is a common embedment length for this size bar. Instead of casting a second slab against the joint face of the first slab, the bars were left protruding from the joint face. Each bar was then pulled with a calibrated hydraulic jack. The amount of displacement, or distance that the bar pulled out was carefully measured as the jacking load was increased. The plotted results are shown in FIG. 9. The bars of the invention permitted 0.1 and 0.12 inches prior to failure. The two conventional tie bars failed at 0.02 and 0.03 inches, respectively. The improvement is approximately 600%.

The yielding tie bar described in FIGS. 1–7 will resist forces acting in a direction normal to the axis of the joint 14 while permitting the joint to open a small predetermined distance to relieve stresses which would cause cracking of the concrete. The yielding tie bar construction shown in FIG. 8 is designed additionally to reduce stresses caused by shrinkage and movement against the tie bar in a direction perpendicular to the resilient facing, or parallel to the joint 14 between the slabs. The modified bar construction of FIG. 8 thus relieves shrinkage stresses in the concrete between adjacent bars on either side of the joint. This bar is rectangular in cross section and has a rubber or plastic facing cushion 34, 36 adhered to the opposed sides of the bar 16. The facing may be attached to one side of the bar as explained in U.S. Pat. No. 4,733,513.

The yielding tie bar of the invention is economically fabricated by mounting the pins or bolts in openings near the ends of the bar. Varying yield strengths are effectively obtained by using pins or bolts of different diameters or lengths which can be purchased from any supplier. The cushioned version of the tie bar can be prepared using strips of cellular rubber or plastic supplied with adhesive already applied, the adhesive being protected by non-adhering glassine paper which is stripped away just prior to assembling. Alternatively, the resilient facing may be connected to the bar by commercially-available EXPANDO-LOK clips, which have foam rubber strips preattached to the clip which snaps over the bar.

I claim:

1. An improved yielding tie bar for transferring load stress across a joint between adjacent concrete slabs, and accommodating internal movement of said slabs to reduce cracking, which comprises a bar capable of extending across said joint substantially perpendicular to the axis thereof and embeddable in said concrete slabs; and a yieldable strip welded to said bar mounted near each end of said bar substantially perpendicular to the axis of said bar, each said strip made of at least one material, with all of the at least one materials of the strip together having a predetermined yield strength (a) sufficient to restrain slab movement in a direction which opens said joint, and (b) insufficient to cause substantial cracking of said slabs.

2. An improved yielding tie bar for transferring load stress across a joint between adjacent concrete slabs, and accommodating internal movement of said slabs to reduce cracking, which comprises a bar capable of extending across said joint perpendicular to the axis thereof and embeddable in the concrete slabs; and a yieldable strip made of yieldable metal welded to said bar mounted near each end of said bar perpendicular to the axis of said bar, each said strip having a predetermined yield strength (a) sufficient to restrain slab movement in a direction which opens said joint and (b) yielding in the metal thereof to an extent that will prevent substantial cracking of said slabs.

3. An improved yielding tie bar for transferring load stress across a joint between adjacent concrete slabs, and accommodating internal movement of said slabs to reduce cracking, which comprises a bar capable of extending across said joint perpendicular to the axis thereof and embeddable in said concrete slabs; and a yieldable strip welded to said bar mounted near each end of said bar perpendicular to the axis of said bar, each said strip having a predetermined yield strength (a) sufficient to restrain slab movement in a direction which opens said joint, and (b) insufficient to cause substantial cracking of said slabs; and with said yieldable strip having an ultimate strength such as to shear off when the width of the joint exceeds a predetermined distance.

4. An improved yielding tie bar for transferring load stress across a joint between adjacent concrete slabs, and accommodating internal movement of said slabs to reduce cracking, which comprises a bar capable of extending across said joint perpendicular to the axis thereof and embeddable in said concrete slabs; and a yieldable strip welded to said bar mounted near each end of said bar perpendicular to the axis of said bar, each said strip made of at least one material, with all of the at least one materials of the strip together having a predetermined yield strength (a) sufficient to restrain slab movement in a direction which opens said joint, and (b) such that said strip will fail before there will be substantial cracking of said slabs.

5. The tie bar of claim 1, claim 2, claim 3 or claim 4 in which said strip is made from among the group consisting of a non ferrous metal and a plastic resin.

6. An improved yielding tie bar as in claim 1, claim 2, claim 3 or claim 4 wherein said bar is rectangular and further comprising a resilient facing attached to at least one face of said rectangular bar to accommodate movement of said concrete slabs in a direction substantially perpendicular to said resilient facing.

7. An improved combination of adjacent concrete slabs, the slabs having a cracking strength and forming at least one joint between the slabs, the combination further comprising a plurality of yielding tie bars for transferring load stress across the joint between the adjacent concrete slabs, and accommodating internal movement of said slabs to reduce cracking, the tie bars each including a bar extending across said joint substantially perpendicular to the axis thereof and embedded in said concrete slabs; and a yieldable pin mounted near each end of said bar substantially perpendicular to the axis of said bar, said pin having a predetermined yield strength (a) sufficient to restrain slab movement in a direction which opens said joint at forces between the slabs below at least 80% of the cracking strength of said slabs, and (b) insufficient to restrain slab movement in a direction which opens said joint at forces between the slabs above at least 80% of the cracking strength of said slabs.

8. An improved combination of adjacent concrete slabs, the slabs having a cracking strength and forming at least one joint between the slabs, the combination further comprising a plurality of yielding tie bars for transferring load stress across the joint between adjacent concrete slabs, and accommodating internal movement of said slabs to reduce cracking, the tie bars each including a bar extending across said joint substantially perpendicular to the axis thereof and embedded in said concrete slabs; and a yieldable pin made of yieldable metal mounted near each end of said bar substantially perpendicular to the axis of said bar, each said pin having a predetermined yield strength (a) sufficient to restrain slab movement in a direction which opens said joint at forces between the slabs below at least 80% of the cracking strength of said slabs, and (b) yielding in the metal thereof at forces between the slabs above at least 80% of the cracking strength of said slabs.

9. An improved combination of adjacent concrete slabs, the slabs having a cracking strength and forming at least one joint between the slabs, the combination further comprising a plurality of yielding tie bars for transferring load stress across the joint between adjacent concrete slabs, and accommodating internal movement of said slabs to reduce cracking, the tie bars each including a bar extending across said joint substantially perpendicular to the axis thereof and embedded in said concrete slabs; and a yieldable pin mounted near each end of said bar perpendicular to the axis of said bar, each said pin having a predetermined yield strength (a) sufficient to restrain slab movement in a direction which opens said joint at forces between the slabs below at least 80% of the cracking strength of said slabs, and (b) insufficient to restrain slab movement in a direction which opens said joint at forces between the slabs above at least 80% of the cracking strength of said slabs; and with said yieldable pin having an ultimate strength such as to shear off when the width of the joint exceeds a predetermined distance.

10. An improved combination of adjacent concrete slabs, the slabs having a cracking strength and forming at least one joint between the slabs, the combination further comprising a plurality of yielding tie bars for transferring load stress across the joint between adjacent concrete slabs, and accommodating internal movement of said slabs to reduce cracking, the tie bars each including a bar extending across said joint substantially perpendicular to the axis thereof and embedded in said concrete slabs; and a yieldable pin mounted near each end of said bar substantially perpendicular to the axis of said bar, each said pin having a predetermined yield strength (a) sufficient to restrain slab movement in a direction which opens said joint at forces between the slabs below at least 80% of the cracking strength of said slabs, and (b) insufficient to restrain slab movement at forces between the slabs above at least 80% of the cracking strength of said slabs such that said pin will fail before there will be substantial cracking of said slabs.

11. The combination of claim 7, claim 8, claim 9 or claim 10 in which said pins have a yield strength which permits said joint to open a distance not exceeding 0.125 inches.

12. The combination of claim 11 in which said yieldable pins shear off when the width of the joint exceeds 0.125 inches.

13. An improved combination as in claim 7, claim 8, claim 9 or claim 10 wherein said bar is rectangular and further comprising a resilient facing attached to at least one face of said rectangular bars to accommodate movement of said concrete slabs in a direction substantially perpendicular to said resilient facing.

14. An improved combination as in claim 7, claim 8, claim 9, or claim 10 in which said pins are bolts extending through openings in said bar and secured to said bar with nuts.

15. An improved combination as in of claim 14 which includes an oversized washer on said bolt.

16. An improved combination as in of claim 7, claim 8, claim 9, or claim 10 in which said pins deform with movement of said slabs, the resistance to bar pull-out increasing as the movement increases.

* * * * *